United States Patent [19]

Collett et al.

[11] Patent Number: 4,986,419

[45] Date of Patent: Jan. 22, 1991

[54] PACKAGING FOR POINT OF SALE DISPLAY, SHIPMENT AND STORAGE OF CASSETTE RECORDINGS AND METHODS

[75] Inventors: Michael F. Collett, Kaysville; Peggy J. Rankin, Kearns, both of Utah

[73] Assignee: Bonneville International Corporation, Salt Lake City, Utah

[21] Appl. No.: 297,219

[22] Filed: Jan. 13, 1989

Related U.S. Application Data

[63] Continuation of Ser. No. 100,511, Sep. 24, 1987, Pat. No. 4,838,420.

[51] Int. Cl.[5] ..... B65D 85/672

[52] U.S. Cl. ..... 206/387; 206/523; 206/592

[58] Field of Search ..... 206/387, 523, 524, 526, 206/585, 588, 591, 592, 593, 594, 459, 424, 311, 497; 229/40, 37.01, 37.02

[56] References Cited

U.S. PATENT DOCUMENTS

| | | | |
|---|---|---|---|
| 1,356,815 | 10/1920 | Foresman | 206/311 |
| 2,011,703 | 8/1935 | Barker | 206/424 |
| 2,998,129 | 8/1961 | Bekins | 206/523 |
| 3,263,892 | 8/1966 | Danyi et al. | 206/459 |
| 3,362,128 | 1/1968 | James | 206/497 |
| 3,451,536 | 6/1969 | O'Leary et al. | 206/451 |
| 3,495,716 | 2/1970 | Gregory | 211/4 |
| 3,587,841 | 6/1971 | Devejian | 206/52 |
| 3,596,754 | 8/1971 | Peterson, Jr. | 206/523 |
| 3,627,115 | 12/1971 | Samalon | 229/40 |
| 3,638,788 | 2/1972 | Solomon | 206/52 R |
| 3,656,612 | 4/1972 | Sellors | 206/45.14 |
| 3,658,240 | 4/1972 | Stoll | 229/40 |
| 3,664,492 | 5/1972 | Wallace | 206/1 R |
| 3,675,763 | 7/1972 | Sandel | 206/45.14 |
| 3,682,297 | 8/1972 | Austin et al. | 206/45.14 |
| 3,743,374 | 7/1973 | Glass | 312/319 |
| 3,744,703 | 7/1973 | Mortenson | 229/27 |
| 3,750,871 | 8/1973 | Cook | 206/523 |
| 3,763,994 | 10/1973 | Somers | 206/1 R |
| 3,776,374 | 12/1973 | Medendorp | 206/45.14 |
| 3,871,516 | 3/1975 | Holkestad et al. | 206/45.31 |
| 3,922,362 | 11/1975 | Pierce | 206/497 |
| 3,933,244 | 1/1976 | Hughes et al. | 206/497 |
| 4,069,359 | 1/1978 | DeMarse et al. | 206/526 |
| 4,125,189 | 11/1978 | Fujimoto et al. | 206/387 |
| 4,134,495 | 1/1979 | Friedman | 206/387 |
| 4,141,446 | 2/1979 | Cliffe | 206/387 |
| 4,154,338 | 5/1979 | Adler | 206/232 |
| 4,193,497 | 3/1980 | McDermott et al. | 206/387 |
| 4,243,142 | 1/1981 | Foreman | 206/387 |
| 4,245,741 | 1/1981 | Holkestad | 206/387 |
| 4,253,568 | 3/1981 | Long et al. | 206/387 |
| 4,282,973 | 8/1981 | Binkowski | 206/523 |
| 4,290,524 | 9/1981 | Azar | 206/232 |
| 4,291,801 | 9/1981 | Basili et al. | 206/387 |
| 4,293,266 | 10/1981 | Lawrence et al. | 414/411 |
| 4,303,159 | 12/1981 | Stone et al. | 206/387 |
| 4,307,806 | 12/1981 | Haubert | 206/387 |
| 4,322,000 | 3/1982 | Struble | 206/387 |
| 4,354,597 | 10/1982 | Garrod | 206/387 |
| 4,361,233 | 11/1982 | Holkestad | 206/387 |
| 4,365,711 | 12/1982 | Long et al. | 206/387 |
| 4,365,712 | 12/1982 | Oishi et al. | 206/387 |
| 4,381,058 | 4/1983 | Chaussadas et al. | 206/497 |
| 4,381,836 | 5/1983 | Rivkin et al. | 206/387 |

(List continued on next page.)

FOREIGN PATENT DOCUMENTS

| | | | |
|---|---|---|---|
| 1410347 | 4/1965 | France | 206/523 |
| 2223254 | 10/1974 | France | 206/523 |

*Primary Examiner*—David T. Fidei
*Attorney, Agent, or Firm*—Lynn G. Foster

[57] ABSTRACT

A packaging system for one or more cassette tape recordings, providing for an improved and simplified point of sale display, shipment and storage, with clear identification of the contents exposed at all times. The system further comprising a printed external paperboard sleeve, dimensioned to force-fit receive one or more boxes each containing a cassette recording and a cushion insert. A transparent plastic shrink-wrap covering surrounds, protects and encloses the assembly.

13 Claims, 3 Drawing Sheets

U.S. PATENT DOCUMENTS

| | | | |
|---|---|---|---|
| 4,385,693 | 5/1983 | Gelardi | 206/387 |
| 4,407,410 | 10/1983 | Graetz et al. | 206/387 |
| 4,428,480 | 1/1984 | Ackeret | 206/387 |
| 4,433,780 | 2/1984 | Ellis | 206/459 |
| 4,438,846 | 3/1984 | Stylianou | 206/387 |
| 4,445,612 | 5/1984 | Shepherd | 206/387 |
| 4,445,634 | 5/1984 | Sato | 229/40 |
| 4,466,540 | 8/1984 | Lotrous | 206/387 |
| 4,469,225 | 9/1984 | Takahashi | 206/387 |
| 4,488,644 | 12/1984 | Wynalda | 206/387 |
| 4,489,832 | 12/1984 | Helms | 206/387 |
| 4,492,417 | 1/1985 | Saito | 312/9 |
| 4,522,303 | 6/1985 | Starr | 206/523 |
| 4,558,782 | 12/1985 | Iverson et al. | 206/387 |
| 4,560,069 | 12/1985 | Simon | 206/591 |
| 4,567,983 | 2/1986 | Morris | 206/387 |
| 4,572,369 | 2/1986 | Morris | 206/387 |
| 4,585,123 | 4/1986 | Penry | 206/387 |
| 4,593,814 | 6/1986 | Hagiwara et al. | 206/387 |
| 4,711,348 | 12/1987 | Sehluger | 206/459 |
| 4,733,775 | 3/1988 | Fireman | 206/523 |
| 4,782,956 | 11/1988 | Yoshizawa | 206/606 |
| 4,838,420 | 1/1989 | Collett et al. | 206/523 |

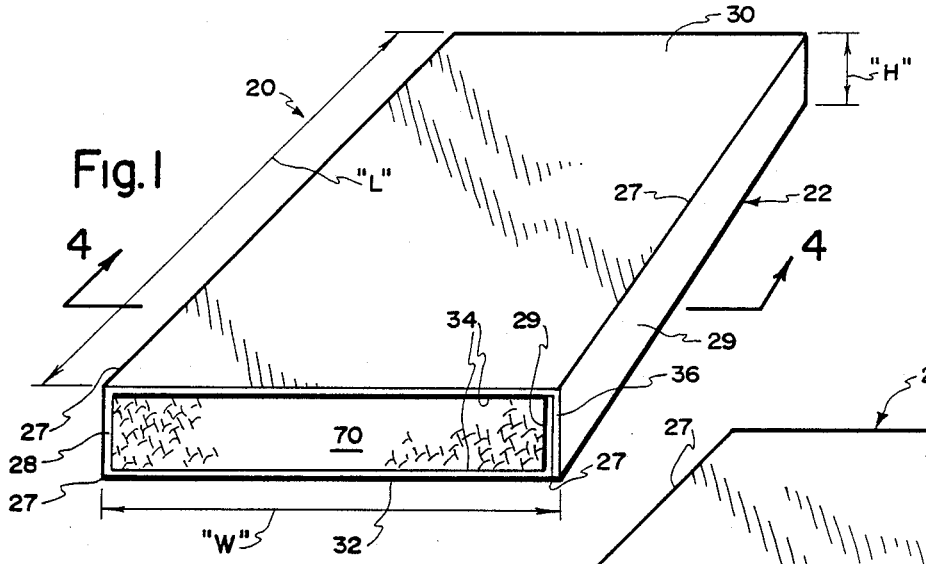
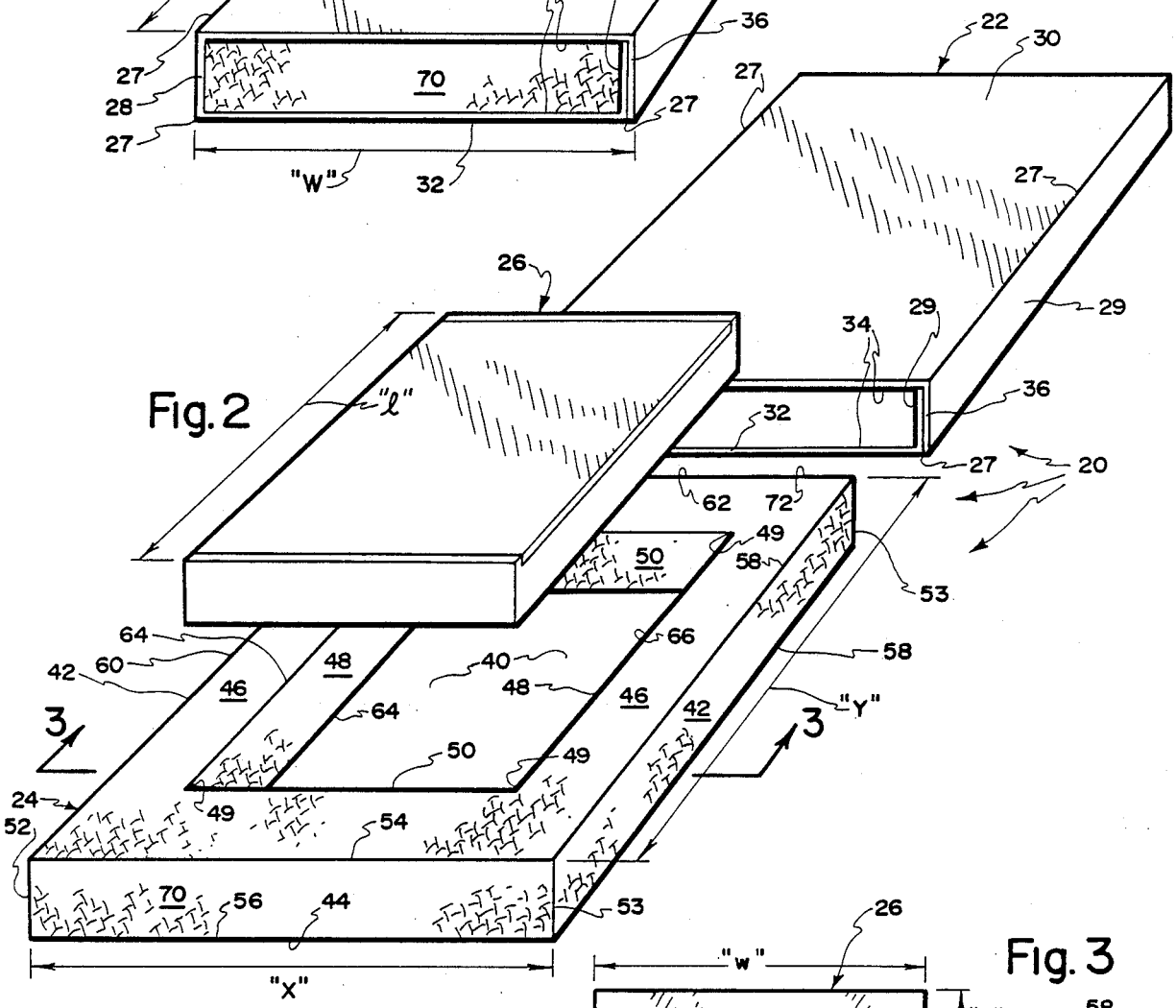
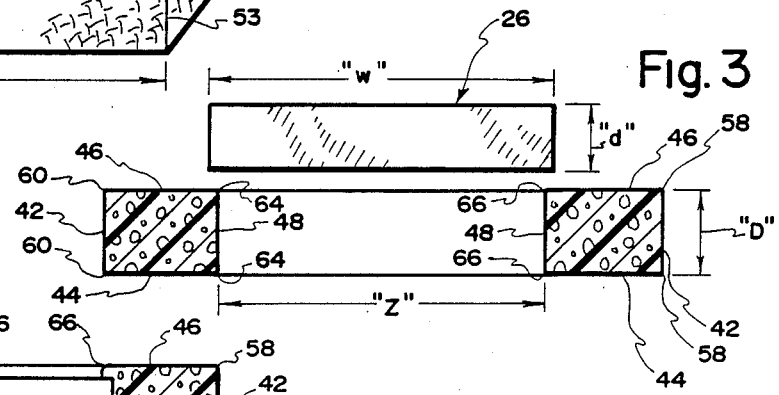
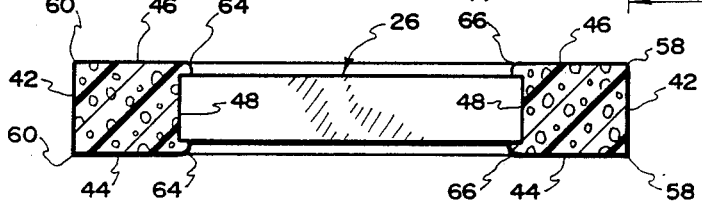
Fig. 4

Fig. 6
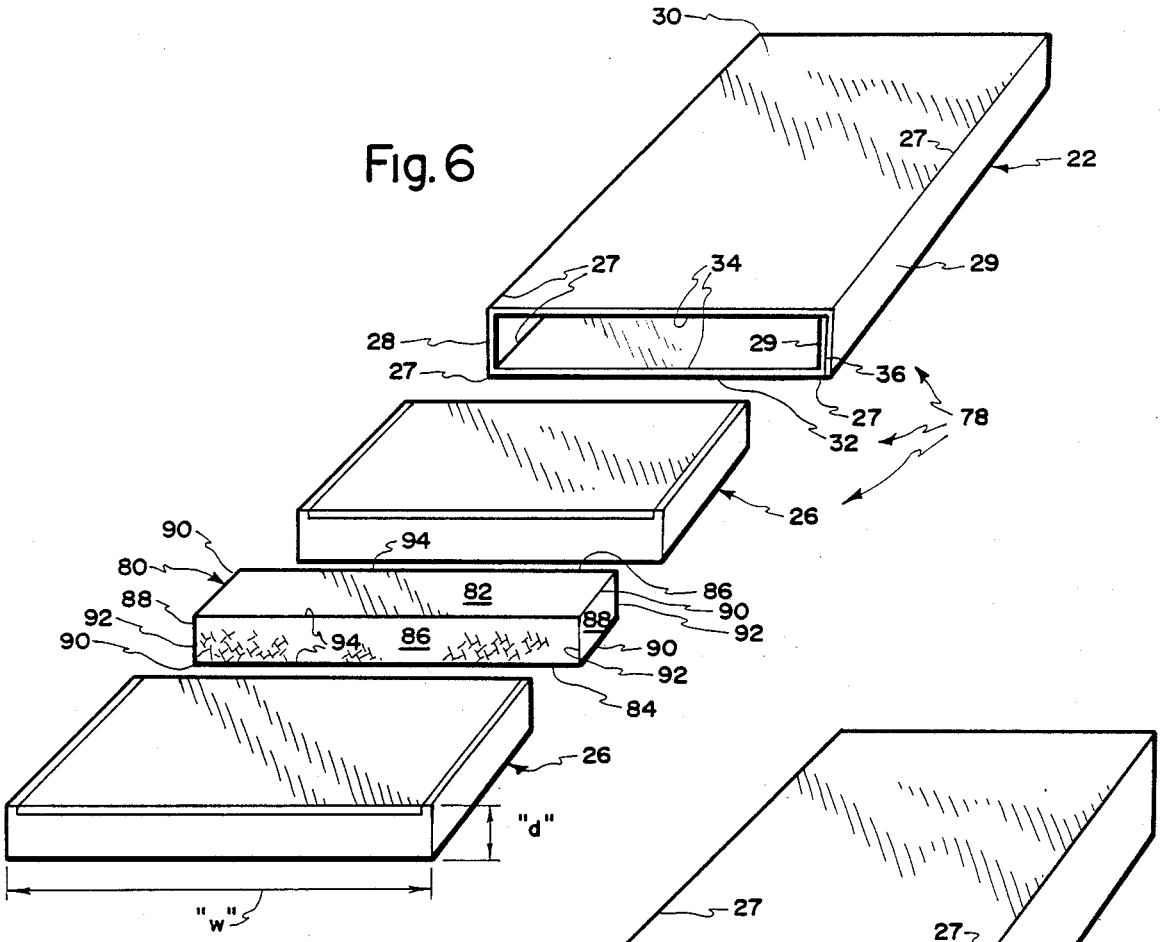
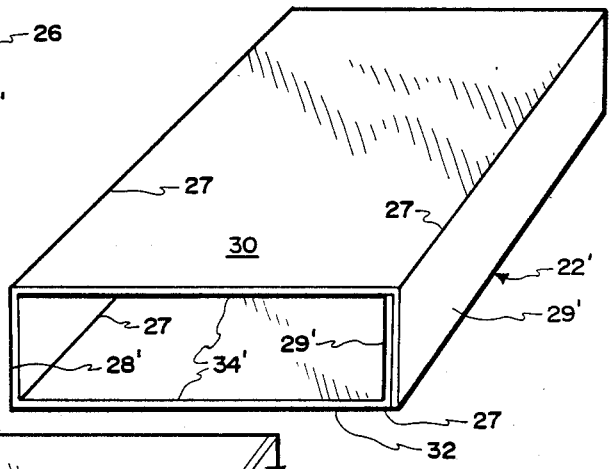
Fig. 7
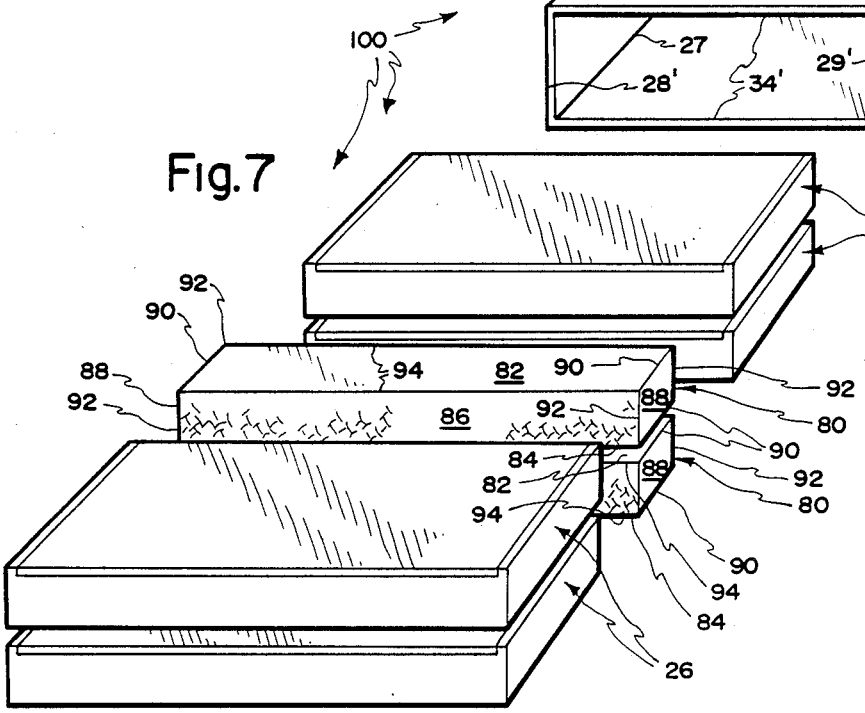

PACKAGING FOR POINT OF SALE DISPLAY, SHIPMENT AND STORAGE OF CASSETTE RECORDINGS AND METHODS

CONTINUITY

This application is a continuation of our copending U.S. patent application Ser. No. 100,511, filed Sept. 24, 1987, now U.S. Pat. No. 4,838,420.

FIELD OF THE INVENTION

This invention relates generally to packaging of cassette recordings, specifically providing for efficient and economical point of sale display, followed by direct-mail distribution and systematic storage by the consumer-user accommodating convenient retrieval and use.

PRIOR ART

Cassette recordings are widely displayed, shipped and stored in today's commercial world in a variety of ways. Many musical entertainment selections, as well as other forms of entertainment, are recorded extensively on cassette tapes. Many educational programs are also recorded on cassette tapes. In addition, private individuals often record personal messages on cassette recordings and distribute them to other persons.

The extensive production, sale and use of cassette tapes entail that the tapes be stored by the seller, displayed at the point of sale, shipped to the buyer and stored for retrieval and reuse by the buyers. It is, therefore, important that an efficient and cost-effective packaging system for cassette tape recordings be devised for point of sale display, shipment and retrievable storage which meets the needs of the commercial manufacturer, the retailer and the buyer. Accordingly, many prior proposals have attempted to address the aforesaid needs. However, none of the prior art proposals represent a satisfactory solution to the mentioned point of sale, shipment and storage problems.

One example of a prior art proposal is found in U.S. Pat. No. 3,664,492, which discloses a rigid container of shape-retaining plastic in which a cassette tape is placed so as to eliminate inadvertent removal of the cassette from the container. The cassette tape container of U.S. Pat. No. 3,664,492 does not address the point of sale and shipment needs of the industry. In addition, imprinting of identifying indicia on the outside of the sleeve is not appropriate due to the material from which the container is formed and because of the recessed nature of the sides of the container.

Another prior art proposal is found in U.S. Pat. No. 3,682,297, which discloses packaging for cassette tapes. However, the primary purpose of the proposal of U.S. Pat. No. 3,682,297 is to reduce pilferage of tapes so packaged through an increased packaging size and does not address the display, shipping and storage needs mention above.

The prior art packaging proposed in U.S. Pat. No. 3,744,703, while designed for shipping cassettes, is unduly complex and expensive and does not adequately protect the cassette against the likelihood of damage during shipment.

A further recent proposal for cassette packaging is found in U.S. Pat. No. 4,385,693, which attempts to allow identification of cassettes without a need to open the package. This proposal is labor-intensive and requires complex features including involved cassette security structure. U.S. Pat. No. 4,385,693 is concerned with providing advertising on a U-shaped insert, which partially surrounds a cassette before the cassette is placed in a conventional cassette housing or box. U.S. Pat. No. 4,385,693 proposes that the ultimate packaging be solely a shrink wrap.

U.S. Pat. No. 4,488,644 proposes that a tray, open at one end only, receive the cassette and that the cassette-loaded tray be linearly inserted and later removed from a complex die-stamped sleeve. This proposal does not adequately protect the goods during shipment.

BRIEF SUMMARY AND OBJECTS OF THE INVENTION

In brief summary, the present invention is directed to cost-effective initial storage, point of sale display, direct-mail shipping, and subsequent user-storage of cassette recordings providing increased reliability, efficiency and utilitarian functions. The outer covering comprises a single piece, open ended paperboard sleeve, creased solely in longitudinal directions by scoring or the like at appropriate intervals, the sleeve being longitudinally joined to itself solely at a lap joint. The sleeve is formed from an initial rectangular blank. The opening at each end allows insertion and removal of one or more cassette containers and one or more foam or like insert cushions on a repeat basis. Preferably a rectangular blank, preprinted with the desired indicia, of one uniform size is used to form all sleeves, the depth of which varies depending on whether one, two, three or four cassette containers are to be placed in the sleeve. The cushions and the sleeve are constructed, sized and shaped to provide a tight fitting assembly in conjunction with the cassettes they are to accommodate to prevent accidental relative displacement between the components of the assembly and damage during shipment and handling. The outer sleeve accommodates imprinting on the exterior thereof of identifying indicia useful as a display at the point of sale and in retrieval by the user from library storage. Preferably, the cassette recordings and the cushions are assembled within the open-ended sleeve using interference-fit principles. The aforementioned assembly is preferably shrink wrapped in suitable transparent film either initially or prior to shipment so that only an address label is added to insure proper shipment to the buyer.

With the foregoing in mind, it is a principal object of the invention to provide a novel system for point of sale display, shipment and storage of cassette recordings.

It is a further significant object to provide an improved packaging display for direct-mail shipment of one or more cassette recordings, which may be directly shipped without further packaging.

It is another important object of this invention to provide for simplified identification and display of prepackaged cassette recordings.

It is a further dominant object of the invention to provide a simplified method of prepackaging cassette recordings, which cost-effectively accommodates point of sale display, shipment and storage thereof.

It is a further valuable object of the present invention to provide a novel, simple, cost-effective, sturdy and durable packaging system for cassette recordings.

Another primary object is the provision of a novel packaging system for cassette recordings which accommodates display, shipment and storage of up to four cassette recordings tightly in a sleeve.

A further significant object is to provide a novel packaging system for cassette recordings which comprises a sleeve to receive up to four cassette tapes formed from a single blank.

These and other objects and features of the present invention will be apparent from the detailed description taken with reference to the accompanying drawings.

BRIEF DESCRIPTION OF THE DRAWINGS

FIG. 1 is a perspective of a packaging system for a single cassette tape fashioned in accordance with the present invention;

FIG. 2 is an exploded perspective of the packaging system of FIG. 1;

FIG. 3 is a cross-sectional view taken along line 3—3 of FIG. 2;

FIG. 4 is a cross-sectional view taken along lines 4—4 of FIG. 1;

FIG. 6 is an exploded perspective view of a further packaging system, in accordance with the principles of the present invention, by which two cassette tapes are displayed, shipped and stored;

FIG. 7 is an exploded perspective view of a third packaging system in accordance with the principles of the present invention, by which four cassette tapes are displayed, shipped and stored.

DETAILED DESCRIPTION OF THE ILLUSTRATED EMBODIMENTS

Figure 5:
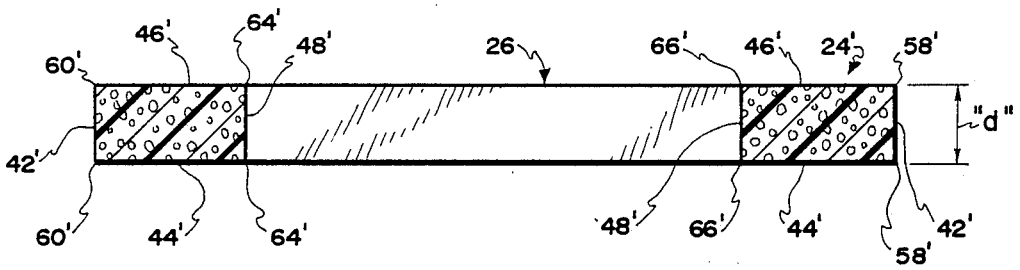
FIG. 5 is a cross-sectional view similar to FIG. 4 of an embodiment where the housing of the single cassette recording has a depth essentially equal to a cushion material into which the housing is inserted.

Reference is now made to the drawings, wherein like numerals are used to designate like parts throughout. Specific reference is made to FIGS. 1 and 2, which illustrates an enclosure or packaging system for a single cassette tape, generally designated 20, constructed in accordance with the principles of the present invention.

FIG. 1 illustrates the enclosure or packaging system 20 in its assembled condition. The packaging system 20 is illustrated as comprising an open ended sleeve, generally designated 22, a cushion insert member, generally designated 24, and a conventional single cassette-receiving rigid plastic housing or box, generally designated 26. It is to be appreciated that other cassette-receiving housings or boxes may be used and, if desired, the cassette itself may be placed directly in the cushion insert member 24.

The sleeve 22 comprises a single sheet of paperboard or like inexpensive, though durable material. It is longitudinally scored, creased or perforated at the four longitudinally directed side corner locations 27, by which side, top and bottom walls 28, 29, 30 and 32 are formed. All of the walls 28, 29, 30 and 32 are illustrated as being of uniform thickness throughout. The rectangular sleeve 22 is entirely open at each end 34. As can be clearly seen by an examination of FIGS. 1 and 2, the sleeve 22 comprises two contiguous side walls 29. Walls 29 comprise a glued lap joint 36.

The height "H" of the sleeve 22 is slightly greater than the height "d" (FIG. 3) of the plastic cassette box 26, which contains a cassette tape recording. The box 26, if desired, may be a Norelco box. The illustrated height "d" in FIGS. 3 and 4, is slightly less than the height "D" of the cushion insert member 24. The width "W" of the sleeve 22 is substantially greater than the width "w" of the box 26. The width "W", however, is slightly less than the width "X" of the cushion insert member 24. The length "L" of the sleeve 22 is substantially greater than length "l" of the box 26. The length "L" of the sleeve 22 and the length "Y" of the cushion insert member 24 are illustrated as being substantially the same. The ends of the cushion insert member 24 become the ends of the pre-packaged assembly 20 when the components thereof are properly placed together in FIG. 1.

However, as illustrated in FIG. 5, the depth of the cushion insert member 24 may be essentially the same as the depth of the cassette housing 26, which embodiment eliminates dead space in which the housing 26 could shift or move during shipment.

To provide point of sale advertising, the exposed surface of any one or more of the sleeve walls 28, 29, 30 and 32 is conventionally imprinted with desired indicia, such as the identifying brand name, the contents of the cassette recording and the performer. This allows ease of retrieval from storage by the ultimate consumer or user without any need whatever of an ancillary storage device. Printing on the exposed surface of either or both side walls 28 and 29, done in an appropriate manner, allows the consumer to store the assembly 20 on one end on a shelf in a manner substantially similar to the way in which books are stored in a library. This allows easy identification of the contents of the cassette recording without removal of the assembly 20 from the shelf. The printed sleeve also improves the inventory storage at the manufacturing site and the display value of the assembly 20 at the point of sale. Preferably, the sleeve is of a size comparable to a paperback book which best accommodates current display racks and display and storage shelves.

Once the cassette recording within the box 26 and the cushion insert member 24 are placed properly in the sleeve 22, the assembly 20 is preferably covered with a transparent outer material (not shown) which preferably comprises a plastic shrink wrap. This provides security against tampering during storage and shipment as well as protection against contaminants, while still providing ease of identification of the contents of the cassette recording. For shipment, no further packaging is needed. An address label is merely attached to the shrink wrap listing the addressee and the correct postage is also added.

FIG. 2 illustrates the relative positions of the components of the assembly 20, which comprise a packaging system for a single cassette recording.

The cushion insert member 24 is illustrated as being essentially rectangular in shape with a central rectangular aperture, opening or window 40 disposed therein. The illustrated respective dimensions of the opening 40 are slightly less than the unstressed width "w" and the length "l" of the box 26, but the opening is slightly greater in its height "D" than the height "d" of the box 26. The external dimensions of the unstressed cushion member 24 are such that the cushion insert member 24 snugly force-fits within the outer sleeve 22 through either open end 34. As such, the height and width dimensions "D" and "X" of the interior of the cushion insert member 26 are slightly greater than the internal height and width dimensions "H" and "W" of the outer endless sleeve 22, allowing for the yieldable material of the cushion insert member 24 to be slightly compressed upon insertion into the sleeve. This prevents inadvertent removal of the cassette box 26 and the cushion insert member 24 from the sleeve 22, while accommodating facile removal when desired by the user. Furthermore, the present invention accommodates ease of repeated assembly and disassembly of the box 26, the cushion 24 and the sleeve 22. As stated earlier, while not critical, the length "Y" of the insert cushion member 24 is illustrated as being substantially the same as the length "L" of the sleeve 22.

Cushion 24 is, as previously described, substantially rectangular comprising exterior blunt side walls 42, which are substantially equidimensional and parallel to each other. The cushion 24 also comprises exterior blunt end walls 70 and 72, which are also substantially parallel to each other. Cushion 24 also comprises top and bottom flat surfaces 46 and 44. Surfaces 46 and 44 respectively merge with end wall 70 at right angle corners 54 and 56. Surfaces 46 and 44 respectively merge with end wall 72 at right angle corners 62, only one of which is illustrated in FIG. 2. One side edge surface 42 merges with end surfaces 70 and 72, respectively, at right angle corners 52, while the other side surface 42 merges with end surfaces 70 and 72, respectively, at right angle corners 53. The opening 40 comprises parallel end wall surfaces 50 and parallel side wall surfaces 48. Each surface 48 merges with the two end wall surfaces 48 at right angle corners 49. Each surface 48 merges with top and bottom surfaces 46 and 44 at right angle corners 66 and 64.

The aforesaid differences in dimensions between the cassette-receiving box 26 and the cushion insert member 24 accommodates the force-fit insertion of the box 26 into the opening from the position illustrated in FIG. 3 to that illustrated in FIG. 4. Thus, the said box 26 is held in removable interference-fit relation within the opening 40. The indicated interference retention of the cassette housing 26 within the aperture 40 of the cushion insert member 24 insures adequate shock protection and otherwise an avoidance of damage to the cassette recording during shipment and storage.

A minor variation in the embodiment of FIGS. 1–4 is shown in FIG. 5.

Cushion insert member 24′ is essentially the same as cushion insert member 24 except as otherwise indicated herein. Cushion insert member 24′ comprises a central rectangular aperture disposed therein. The illustrated respective unstressed dimensions of the central opening of member 24′ are illustrated as being substantially the same as the outside dimensions of the box 26 so that the box 26 fits flush and snugly within the central opening of member 24′. The external dimensions of the unstressed cushion member 24′ are such that the cushion insert member 24′ snugly force-fits within the outer sleeve 22 through either open end 34. This prevents inadvertent removal of the cassette box 26 and the cushion insert member 24′ from the sleeve 22, while accommodating facile removal when desired by the user. Furthermore, the present invention accommodates ease of repeated assembly and disassembly of the box 26, the cushion 24′ and the sleeve 22.

Cushion 24′ is substantially rectangular comprising exterior blunt side walls 42′, which are substantially equidimensional and parallel to each other. The cushion 24′ also comprises exterior blunt end walls, which are substantially parallel to each other. Cushion 24′ also comprises top and bottom flat surfaces 46′ and 44′. Surfaces 46′ and 44′, respectively, merge with end walls at right angle corners. The opening comprises parallel end wall surfaces and parallel side wall surfaces 48′. Each surface 48′ merges with top and bottom surfaces 46′ and 44′ at right angle corners 66′ and 64′.

The aforesaid dimensions of the cushion insert member 24′ accommodates snug insertion of the box 26 into the opening of the member 24′ leaving essentially no dead space as shown in FIG. 5. Thus, the said box 26 is held in removable interference-fit relation within the opening of the cushion member 24′. The snug retention of the cassette housing 26 within the aperture of the cushion insert member 24′ insures adequate shock protection, an absence of relative movement, especially during shipment, and otherwise an avoidance of damage to the cassette recording during shipment and storage.

Another embodiment of the present invention is illustrated in FIG. 6, which provides for a point of sale display, shipment and storage of two cassette recordings in a single assembly, generally designated 78. The assembly 78 comprises two of the heretofore described boxes 26, each of which contains a cassette recording. The assembly also comprises an endless sleeve 22′, which is identical to the described sleeve 22, except the size thereof is adjusted to receive the two cassette boxes 26 each in interference-fit relation. The assembly 78 also comprises a cushion insert member 80, which is sized and shaped to be tightly force-fit transversely within the sleeve 22′ at the center thereof. In the installed position, the boxes 26 are respectively exposed at the opposite ends 34 of the sleeve 22′. The insert 80 provides additional protection against inadvertent lateral displacement or crushing of the cassette tapes during shipment, as well as shock protection.

The insert 80 is comprised of a rectangular block, preferably formed of synthetic resinous foam material. The insert 80 is comprised of opposite equidimensional parallel side wall surfaces 88 and parallel equidimensional parallel end wall surface 86. The block 80 also comprises opposed equidimensional parallel top and bottom wall surfaces 82 and 84. Each wall surface is joined to all other contiguous wall surfaces at right angle corners 84, 86, 88, 90, 92 and 94, thus forming the rectangular block shown in FIG. 6. Both the length and height of the insert 80 are slightly greater than the corresponding dimensions of the outer sleeve 22′. Thus, when placed within the enclosure, the insert 80 is received and held centrally in place by an interference-fit, as are the two cassette-receiving housings 26.

A further embodiment of the present invention is illustrated in FIG. 7, which provides for point of sale display, shipment and storage of four cassette recordings in a single assembly, generally designated 100. The assembly 100 comprises four of the heretofore described boxes 26, each of which contains a cassette recording. The assembly also comprises an endless sleeve 22′, which is identical to the heretofore described sleeve 22, except the size is adjusted to receive the four cassette boxes 26 in interference-fit relation. The assembly 100 also comprises two of the heretofore described cushion insert members 80, stacked vertically one upon the other so that together they are tightly force-fit transversely within the sleeve 22′ at the center thereof. In the installed position, two stacked boxes 26 are exposed at each end 34′ of the sleeve 22′. The length and height of the stacked inserts 80 are slightly greater than the corresponding length and height of the outer sleeve 22′.

Thus, when placed in stacked relation within the sleeve 22', the inserts 80 are received and held in place by an interference-fit, as are the two stacked sets of cassette-receiving housings 26.

Figure 8:
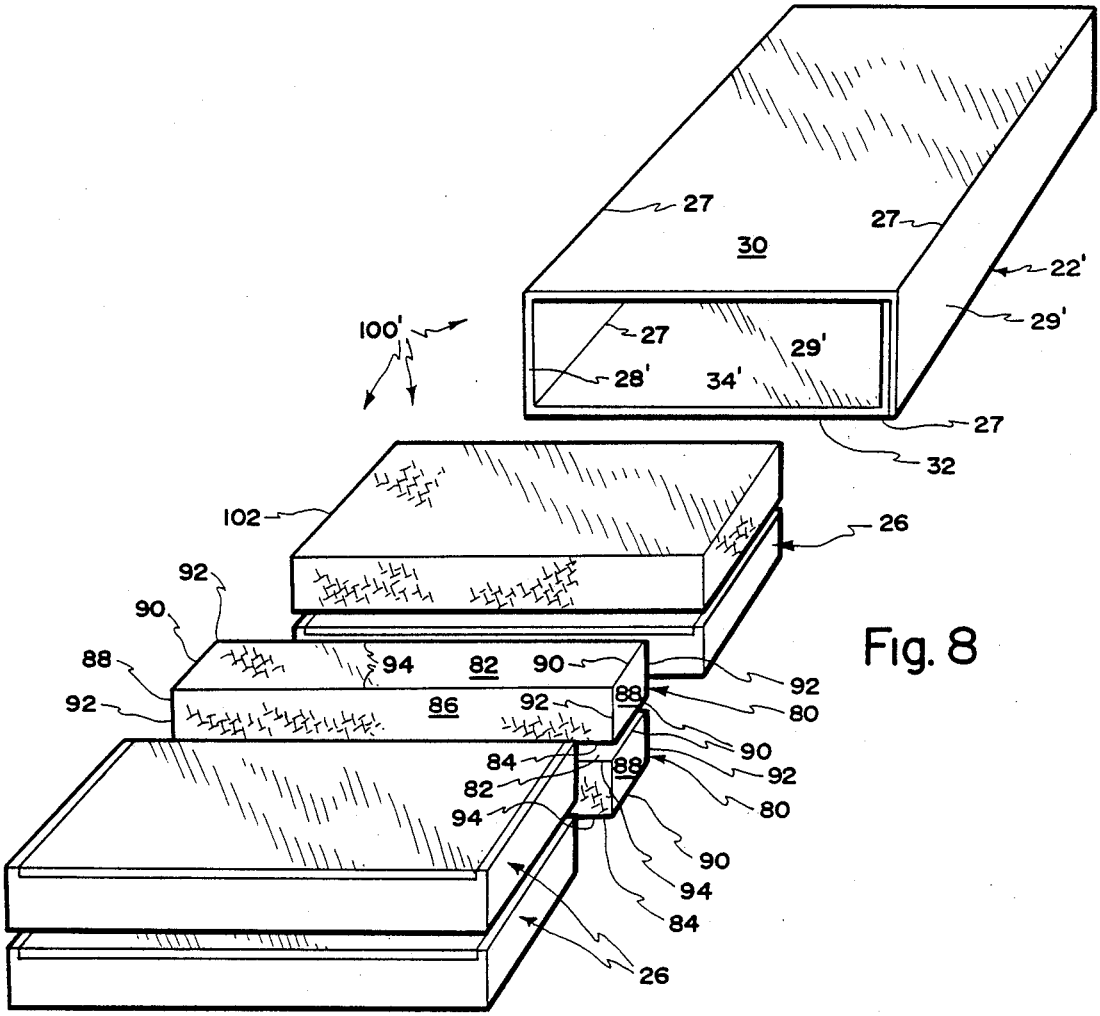
FIG. 8 is an exploded perspective view of a fourth packaging system, in accordance with the principles of the present invention, by which three cassette recordings are displayed, shipped and stored.

A further embodiment of the present invention is illustrated in FIG. 8, which provides for point of sale display, shipment and storage of three cassette recordings in a single assembly, generally designated 100'. The assembly 100' is substantially identical to assembly 100 except as otherwise herein indicated. The assembly 100' comprises three of the heretofore described boxes 26, each of which contains a cassette recording. The assembly 100' also comprises the heretofore described endless sleeve 22'. The assembly 100' also comprises two of the heretofore described cushion insert members 80, stacked vertically one upon the other so that together they are tightly force-fit transversely within the sleeve 22' at the center thereof. The assembly 100' also comprises a further larger insert cushion member 102, which is strictly rectangular and of a size identical to the size of the box 26. In the installed position, two stacked boxes 26 are exposed at one end 34' of the sleeve 22'. The length and height of the two stacked inserts 80 are slightly greater than the corresponding length and height of the outer sleeve 22'. Thus, when placed in stacked relation within the sleeve 22', the inserts 80 are received and held in place by an interference-fit, as is the stacked set of two cassette-receiving housings 26. One box 26 and the rectangular insert cushion member 102 are similarly stacked and interference-fit into the other opening of the sleeve 22'.

It is to be appreciated that all embodiments of the present invention contemplate use of a transparent shrink wrap or the like covering, as above described.

If desired, a single rectangular blank, preprinted with suitable indicia, can be used to form each of the external sleeves used to receive one, two, three or four cassette recordings in boxes.

The invention may be embodied in other specific forms without department from the spirit or essential characteristics thereof. The present embodiments, are, therefore, to be considered in all respects as illustrative and not restrictive, the scope of the invention being indicated by the appended claims rather than by the foregoing description, and all changes which come within the meaning and range of equivalence of the claims are therefore to be embraced therein.

What is claimed and desired to be secured by U.S. Letters Patent is:

1. An assembly for point of sale display, shipment, after purchase retrievable, vertically oriented storage and off-the-shelf after purchase handling of one to several cassette recordings, at any one point in time, the assembly comprising:

external substantially rectangular sleeve means of sheet material comprising exposed exterior surface means comprised of opposed side wall means and opposed front and rear wall means, a hollow interior within the wall means, means defining at all points in time a permanent non-closable opening at each end of the sleeve means, the permanent opening at each end being defined by end edges of the opposed side, front and rear wall means collectively disposed in a common plane, at least some of the exposed exterior surface means of the sleeve means comprising identifying indicia visually observable both when the assembly is displayed at a point of sale and after sale when vertically placed on one of the end edges in library-like storage;

cassette recording means comprising at least one and up to several cassettes inserted through one of the end openings and disposed at any one point in time within the sleeve means;

cushion insert means having a cross-section substantially similar to the cross-section of the hollow interior of the sleeve means, dimensioned to linearly slide into and out of the hollow interior of the sleeve means through either end opening by manual force but comprising means creating a snug assembled relation between the cushion insert means and the sleeve means prohibiting inadvertent separation through either opening, the cushion insert means further comprising means contiguously engaging at least one edge of each cassette comprising the cassette recording means accommodating intentional placement and removal of the cassette recording means and the cushion insert means so as to prevent inadvertent separation of the cassette recording means and cushion insert means from the assembly through either opening after the assembly is telescopically assembled.

2. An assembly according to claim 1 further comprising a transparent shipment plastic wrapping upon the assembled assembly surrounding the sleeve means so that the identifying indicia are visually exposed through the wrapping and only an address label associated with the wrapping during shipment.

3. An assembly according to claim 1 wherein the wall means of the sleeve means configurate the hollow interior so that it comprises a substantially uniform rectangular cross-section.

4. An assembly according to claim 1 wherein the wall means comprise a single rectangular blank folded in part upon itself and adhered to form a longitudinally-directed lap joint comprising one side wall means.

5. An assembly according to claim 1 wherein the sleeve means comprise a single sheet of paperboard material.

6. An assembly according to claim 1 wherein the cassette recording means comprise one or more cassette tapes each enclosed within a cassette housing.

7. An assembly according to claim 1 wherein the cushion insert means comprise a material substantially more yieldable to force than the cassette recording means.

8. An assembly according to claim 1 wherein the cushion insert means comprise a synthetic resinous foam material.

9. An assembly according to claim 1 wherein the cross-section of the cushion insert means is substantially uniform throughout the length thereof and in an unstressed condition comprises an area slightly greater than the unstressed cross-sectional area of the hollow interior of the sleeve means.

10. An assembly according to claim 1 wherein the cross-section of the cushion insert means is of substantially uniform rectangular cross-section throughout the length thereof.

11. An assembly according to claim 1 wherein the central means of the cushion insert means comprise a rectangular opening into which the cassette recording means are inserted.

12. An assembly according to claim 11 wherein the rectangular opening is sized so as to be slightly compressed when the cassette recording means are forcibly inserted into the rectangular opening.

13. An assembly for point of sale display, shipment after purchase retrievable vertical exposed edge storage, and off-the-shelf after purchase handling of at least one and up to several separate cassette recordings which may be stored vertically comprising:

external substantially rectangular sleeve means of sheet material comprising exposed exterior surface means comprised of opposed side wall means and opposed front and rear wall means, a hollow interior within the wall means, means defining at all points in time a permanent non-closable opening at each end of the sleeve means, the opening at each end being defined by end edges of the opposed side, front and rear wall means collectively disposed in a common plane, at least some of the exposed exterior surface means of the sleeve means comprising identifying indicia visually observable both when the assembly is displayed at a point of sale and after sale when vertically placed on one of the end edges in library-like storage;

cassette recording means comprising at least one and up to several separate cassette recordings inserted through either end opening and disposed at any one point in time within the sleeve means;

cushion insert means having a cross-sectional configuration substantially duplicative of the cross-sectional configuration of the hollow interior of the sleeve means, the cushion insert means being dimensioned to linearly forcibly slide into the hollow interior of the sleeve means through either end openings by manual force but comprising means creating a snug assembled relation between the cushion insert means and the sleeve means prohibiting inadvertent separation through either open end, the cushion insert means further comprising means contiguously engaging the cassette recording means when the cassette recording means and the cushion insert means are placed within the sleeve means whereby the cassette recording means and the cushion insert means may not be inadvertently removed from the sleeve means.

* * * * *